US007363695B2

(12) United States Patent
Chu

(10) Patent No.: US 7,363,695 B2
(45) Date of Patent: Apr. 29, 2008

(54) METHOD OF FABRICATING A TEMPERATURE SENSING TUBE

(76) Inventor: Kuan-Yu Chu, No. 63, Ta-De 1st Road, Kangshan Town, Kaohsiung Hsien (TW)

( * ) Notice: Subject to any disclaimer, the term of this patent is extended or adjusted under 35 U.S.C. 154(b) by 387 days.

(21) Appl. No.: 10/774,429

(22) Filed: Feb. 10, 2004

(65) Prior Publication Data

US 2005/0172693 A1 Aug. 11, 2005

(51) Int. Cl.
*G01R 3/00* (2006.01)

(52) U.S. Cl. ..... 29/595; 29/592.1; 29/611; 29/844; 29/852; 29/882; 73/866.5; 83/29; 83/35; 83/36; 374/139; 374/140; 374/141; 374/208

(58) Field of Classification Search ..... 29/592.1, 29/595, 611, 844, 852, 882; 73/866.5; 83/29, 83/35, 36, 50; 374/139, 140, 141, 208
See application file for complete search history.

(56) References Cited

U.S. PATENT DOCUMENTS 5,131,759 A * 7/1992 Eiermann et al. ..... 374/208
5,180,228 A * 1/1993 Tarumi et al. ..... 374/139
5,743,646 A * 4/1998 O'Connell et al. ..... 374/148

* cited by examiner

*Primary Examiner*—Paul D. Kim
(74) *Attorney, Agent, or Firm*—Bacon & Thomas, PLLC

(57) ABSTRACT

A temperature sensor temperature sensing tube and its fabrication method comprised of a step that provides for a tubular blank of an appropriate length, a step in which a curvilinear semifinished product of the tube member bottom section aperture is formed, a step in which a semifinished product of the neck base and the neck body is formed, a step in which a semifinished product of the neck base and the neck body is further formed, and a step in which a finished product having an outer conoidal hem and an inner conoidal hem is formed. Executing each step completes the fabrication of the temperature sensing tube.

5 Claims, 7 Drawing Sheets

METHOD OF FABRICATING A TEMPERATURE SENSING TUBE

BACKGROUND OF THE INVENTION

1) Field of the Invention

The invention herein relates to temperature measuring component production processes, specifically a temperature sensor temperature sensing tube and its fabrication method in which the temperature sensor temperature sensing tube is of one-piece forged construction and completed in a series of steps.

2) Description of the Related Art

Products such as automobiles, stoves, water heaters, and air conditioners are typically equipped with temperature sensors to monitor changes in temperature for effecting appropriate control. As indicated in FIG. 1, a conventional temperature sensor consists of external threads 11 died along the outside, a seat 12 of a carrier mount 1, internal threads 13 tapped along the interior of a receiving recess 14, an opening 15 formed in the receiving recess 14, an annular flange 16 protruding inward between the receiving recess 14 and the opening 15; a threaded pin component 2 having a turning section 21 and external threads 22, with a bore 23 inside; a flat shaped retaining section 24 on the end portion of the threaded pin component 2; a temperature sensing tube 3 consisting of a head section 31 and a tube member 32, wherein a bottom base 33 is formed at the lower extent of the head section 31, a flat circular surface 34 is formed at the upper extent, a neck section 35 formed above it, and a passage 36 is disposed in the neck section 35; the hollow interior section of the tube member 32 is contiguous with the said passage 36 and there is an aperture 37 in the bottom section.

In such temperature sensors, the temperature sensing tube 3 is placed into the carrier mount 1 receiving recess 14, enabling the tube member 32 to extend through the opening 15 such that the bottom base 33 is against the carrier mount 1 annular flange 16, and then the threaded pin component 2 retaining section 24 is fastened tightly against the temperature sensing tube 3 circular surface 34; utilization consists of filling the interior section of the temperature sensing tube 3 with a temperature sensing liquid and connecting wires from the temperature sensing tube 3 neck section 35 to a thermometer; when the entire temperature sensor is installed such that the temperature sensing tube 3 is exposed to a heat source, the reaction of the temperature sensing liquid inside the temperature sensing tube 3 is transferred via the wiring to the thermometer and indicated (since the temperature sensing liquid, wiring, and thermometer are not included in the invention herein, they are not shown in the drawings).

Wherein, the said temperature sensing tube 3 typically involves, as indicated in FIG. 2, first fabricating the head section 31 into a single structural component on an automatic lathe and then turning the tube member 32 on an automatic lathe from a solid rod into a single structural component, following which the two are welded into one piece; as such, the structure not only consumes time and effort, but results in higher cost and lower production efficiency, while the welding seam sealing integrity affects dimensional precision and temperature sensing performance.

SUMMARY OF THE INVENTION

The objective of the invention herein is to provide a temperature sensing tube fabrication method comprised of:

A step that provides for a tubular blank of an appropriate length.

A step in which a curvilinear semifinished product of the tube member bottom section aperture is formed.

A step in which a semifinished product of the neck base and the neck body is formed.

A step in which a semifinished product of the neck base and the neck body is further formed.

A step in which a finished product having an outer conoidal hem and an inner conoidal hem is formed.

As such, executing each said step completes the fabrication of the temperature sensing tube of the present invention.

BRIEF DESCRIPTION OF THE DRAWINGS

Other features and advantages of the present invention will become apparent in the following detailed description of the preferred embodiments, with reference to the accompanying drawings, in which.

DETAILED DESCRIPTION OF THE PREFERRED EMBODIMENTS

Figure 1:
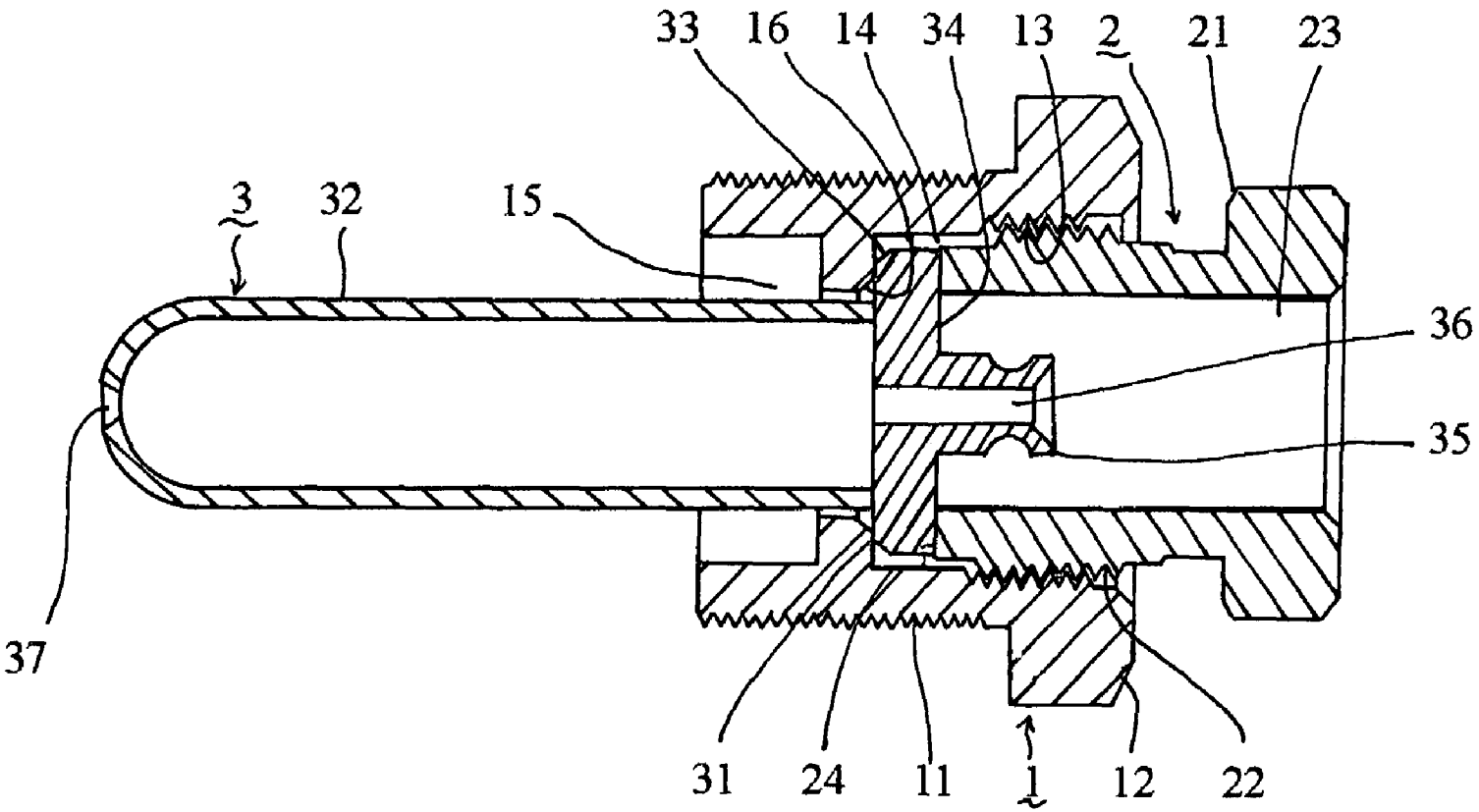
FIG 1 (Prior Art)
FIG. 1 is a cross-sectional drawing of a conventional temperature sensor structure.
Figure 2:
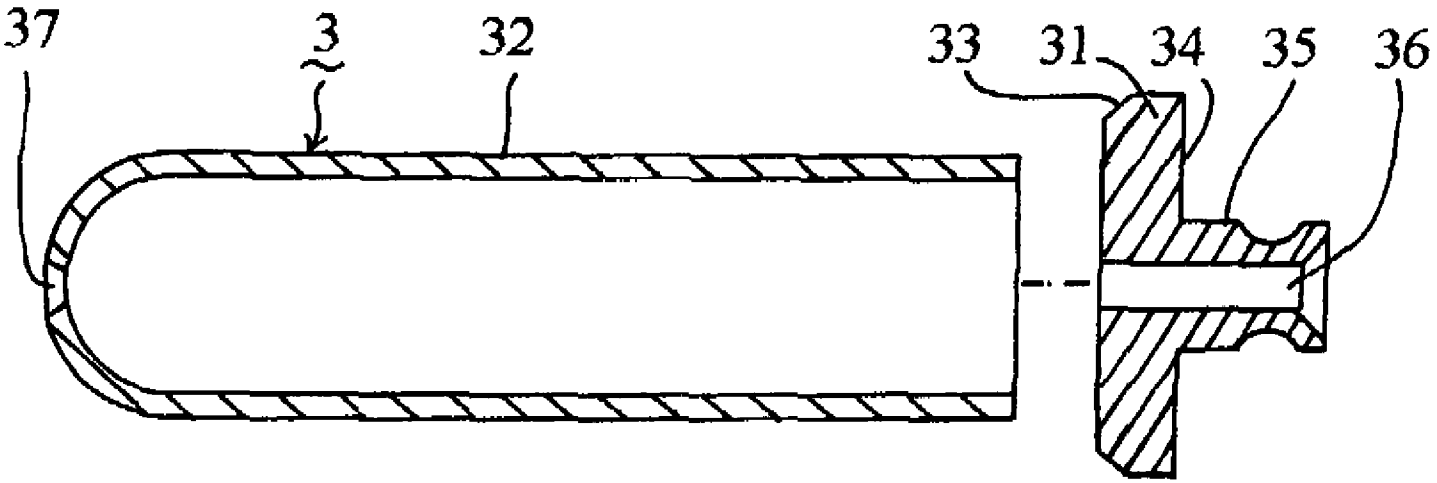
FIG 2 (Prior Art)
FIG. 2 is a cross-sectional drawing of a conventional temperature sensing tube structure.

In the detailed description of the preferred embodiments, it should be noted that similar elements are indicated by the same reference numerals throughout the disclosure.

Figure 3:
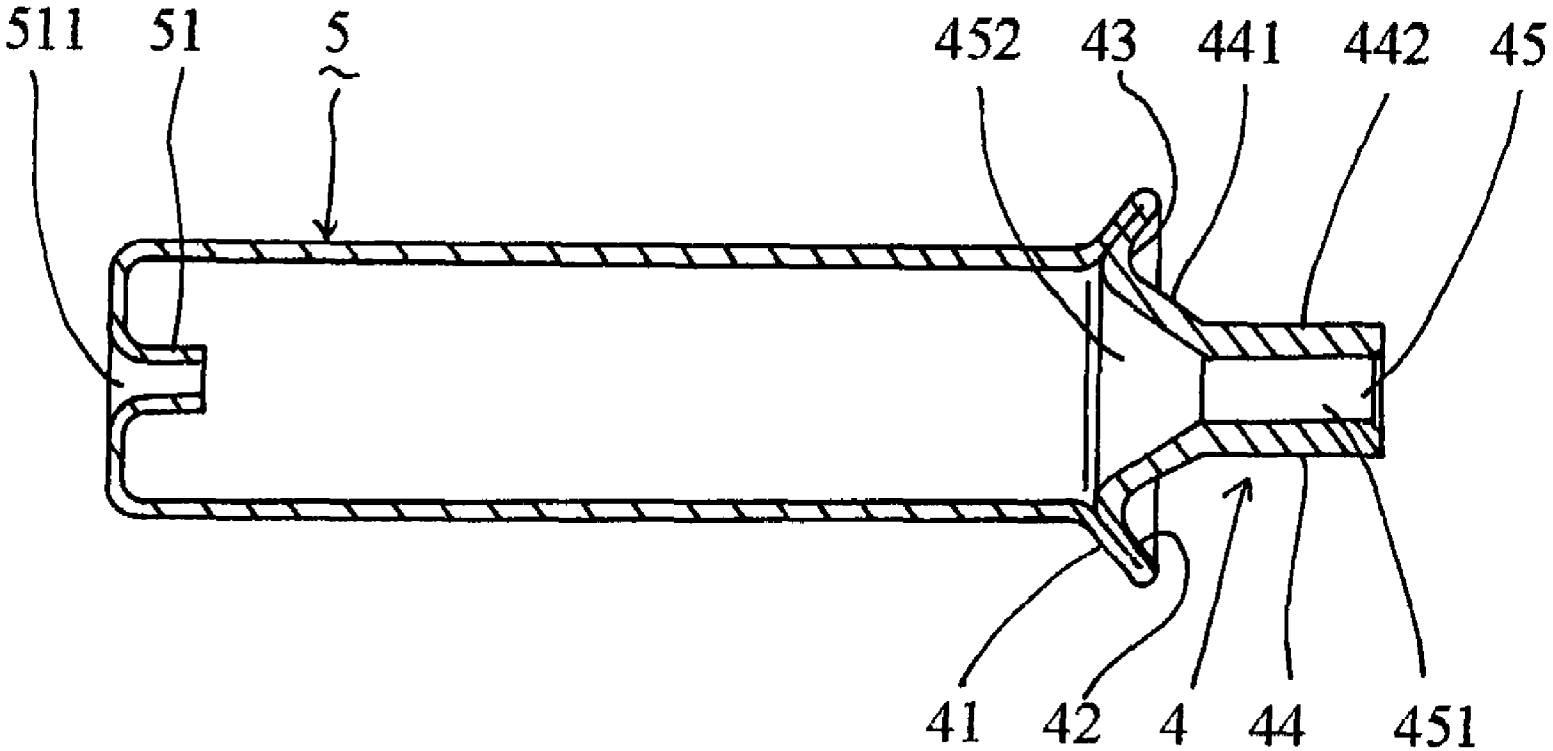
FIG. 3 is a cross-sectional drawing of the finished preferred embodiment temperature sensing tube structure of the invention herein.

Referring to FIG. 3, the finished preferred embodiment temperature sensing tube structure of the invention herein is comprised of:

A tube member 5 that includes a head section 4 having an outer conoidal hem 41 and an inner conoidal hem 42 formed along the circumference at its lower extent, wherein the inner conoidal hem 42 is fashioned by acutely bending the upper circumferential edge of the outer conoidal hem 41 into a U-shape such that it overlaps against the outer conoidal hem 41; wherein, a neck section 44 is formed at the bottom section 43 and center of the conoidal hem 42 that includes a gradually reduced neck base 441 which is larger than and formed upward from the bottom section 43 and continues extending above into a neck body 442 having an approximately equal tubular diameter, a passage 45 is disposed in the neck section 44, said passage 45 including a hole section 451 of a nominally constant inner diameter that matches the neck body 442 and a conic hole section 452 of graduated reduction from the bottom towards the top that matches the neck base 441.

The tube member 5 has a hollow interior section that is contiguous with the said passage 45 and a hole mount 51 formed inward at the bottom section, with an aperture 511 disposed in the hole mount 51.

Since the head section 4 and the tube member 5 are forged from a tubular blank into a one-piece, entirely unitary structural component, no welding is involved in the conjoinment of the head section 4 and the tube member 5 into a single structural entity.

Figure 4:
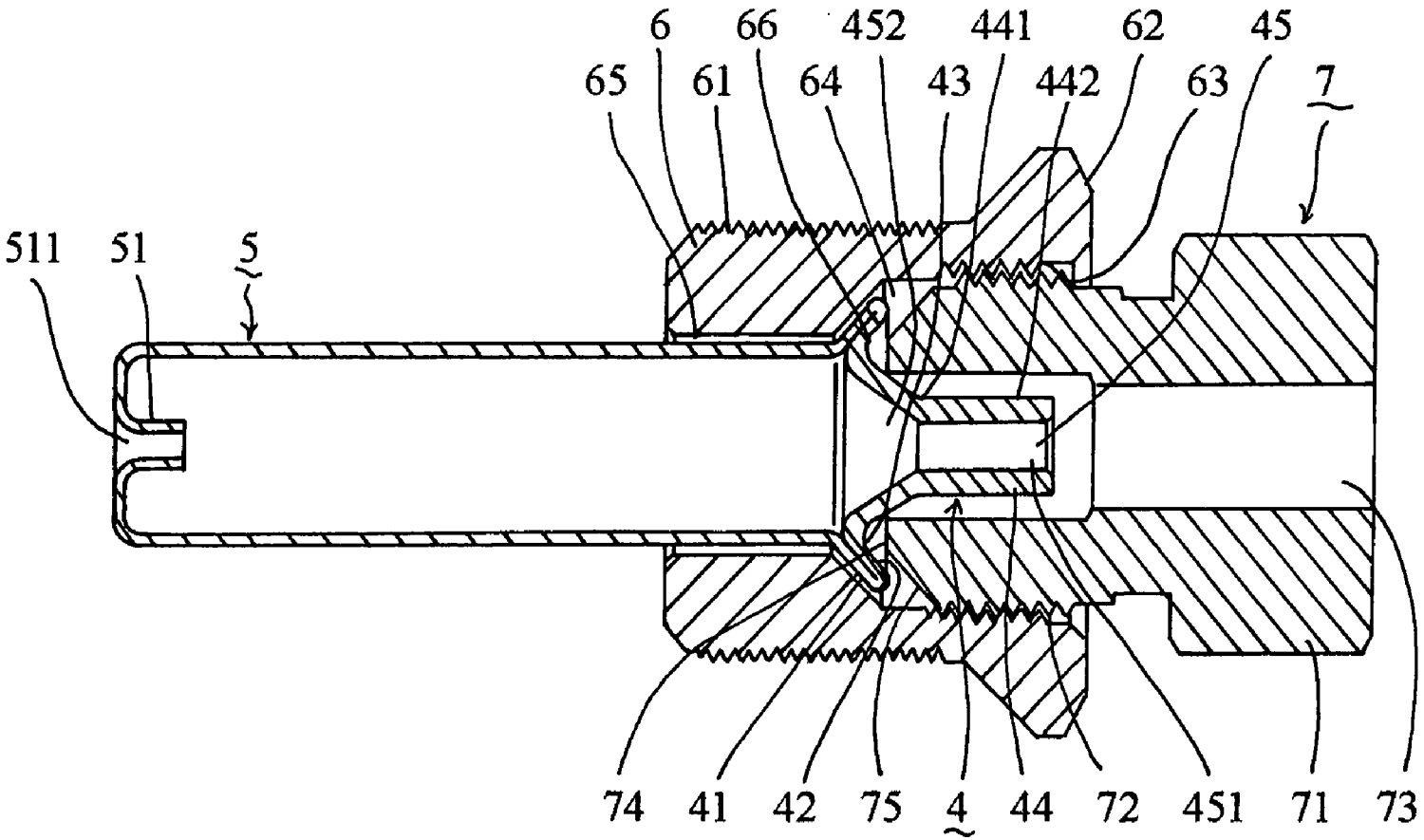
FIG. 4 is a cross-sectional drawing of the finished preferred embodiment of the invention herein utilized on a temperature sensor structure.

Referring to FIG. 4, in the finished preferred embodiment temperature sensor temperature sensing tube of the invention herein, the present invention is equipped with a carrier mount 6 and a threaded pin component 7.

The carrier mount 6 has external threads 61 and a seat 62 as well as a receiving recess 64 inside tapped with internal threads 63; an opening 65 is formed in the receiving recess 64 and a conoidal guide edge 66 is disposed between the receiving recess 64 and the opening 65.

The threaded pin component 7 has a turning section 71 and external threads 72, with a bore 73 formed inside; the end portion of the threaded pin component 7 is shaped such that it has a flat bottom section 74 and a beveled edge 75.

When the finished preferred embodiment temperature sensing tube of the invention herein is utilized on a temperature sensor, the temperature sensing tube is fitted into the carrier mount 6 receiving recess 64, causing the tube member 5 to extend through the opening 65 such that the outer conoidal hem 41 contacts the carrier mount 6 conoidal guide edge 66 and the threaded pin component 7 bottom section 74 is fastened against the temperature sensor bottom section 43, while the threaded pin component 7 beveled edge 75 is secured against the temperature sensing tube conoidal hem 42 to create a tight seal; during utilization, the temperature sensing tube is filled with a temperature sensing liquid and wiring from the temperature sensing tube neck section 44 is connected to a thermometer; when the entire temperature sensor is installed such that the temperature sensing tube contacts a heat source, the reaction of the temperature sensing liquid inside the temperature sensing tube is transferred via the wiring to the thermometer and indicated (since the temperature sensing liquid, wiring, and thermometer are not included in the invention herein, they are not shown in the drawings).

The preferred embodiment of the invention herein provides a design in which the head section 4 has the inner conoidal hem 42 at its lower extent that is extended from the tube member 5 to form the outer conoidal hem 41, and then bending the upper circumferential edge of the outer conoidal hem 41 into a U-shaped such that it overlaps against the outer conoidal hem 41, following which a neck section 44 is formed from the bottom section 43 that is larger than the bottom section 43, with a gradually reduced neck base 441 articulated upward and continuing to extend above into the neck body 442; such a design not only enables the forming of the temperature sensing tube as a one-piece structure to save production process time and effort as well as lowering costs and increasing production efficiency, but also reduces welding seam sealing that influences dimensional precision and temperature sensing performance; at the same time, when the threaded pin component 7 is tightly fastened against the temperature sensing tube, the beveled edge 75 and the conoidal hem 42 are in a conically nested state, the threaded pin component 7 fastened to the temperature sensing tube and sealing the opening 65 of the carrier mount 6 receiving recess 64 with exceptionally fine efficiency and excellent sealing to further benefit temperature sensing tube reaction accuracy during temperature measurements.

Figure 5:
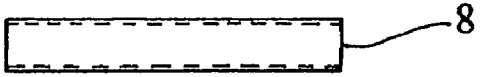
FIG. 5 is an orthographic drawing of the first step in the preferred embodiment fabrication of the invention herein.

Referring to FIG. 5, FIG. 6, FIG. 7, FIG. 8, FIG. 9, and FIG. 10, the one-piece fabrication method of the temperature sensing tube includes:

A first step, referring to FIG. 5, that provides for a blank tubular member 8 of an appropriate length.

Figure 6:
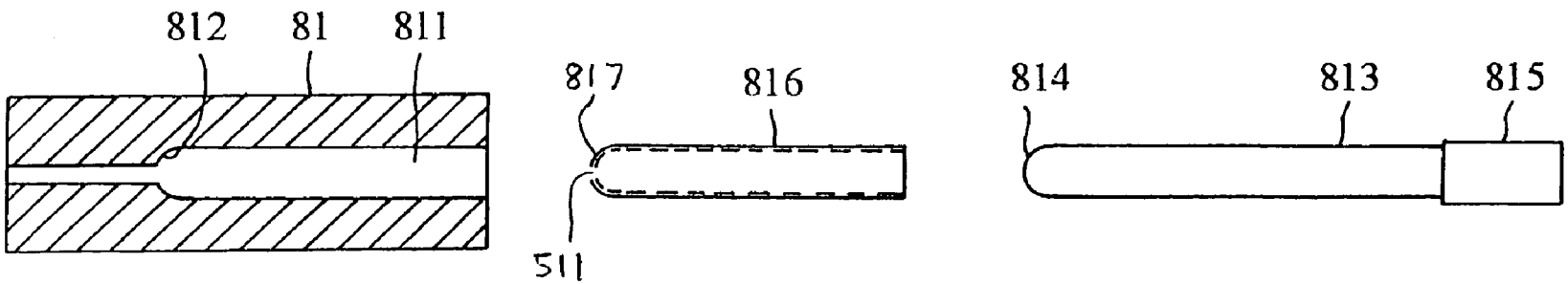
FIG. 6 is a cross-sectional drawing of the second step in the preferred embodiment fabrication of the invention herein.

A second step, referring to FIG. 6, in which the tubular member 8 formed in the previous step is moved between a female die 81 having a die cavity 811 and a curved bottom edge 812 and a punching rod 815 having a thin lengthy rod section 813 and a curved front end section 814 for impact forging to thereby form a first semifinished product 816 of the tube member 5 having a curvilinear bottom end 817 defining a bottom section aperture 511.

Figure 7:
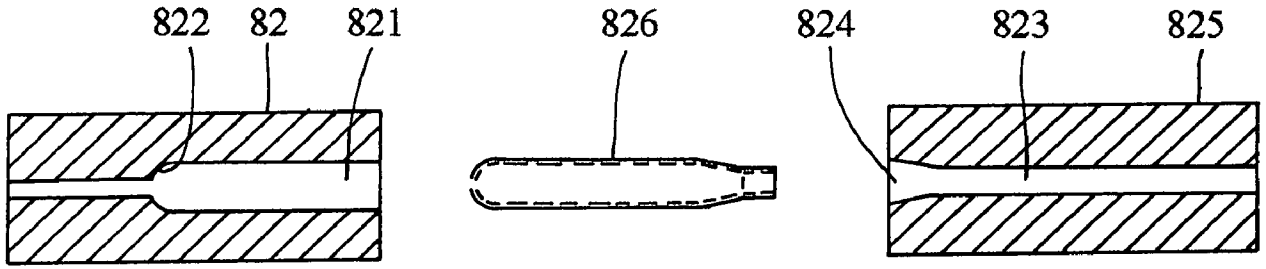
FIG. 7 is a cross-sectional drawing of the third step in the preferred embodiment fabrication of the invention herein.

A third step, referring to FIG. 7, in which the tubular member 8, formed into the first semifinished product 816 of the previous step, is moved between a female die 82 having a die cavity 821 and a curved bottom edge 822 and a punching die 825 having a channel 823 and a suitably long flared hole section 824 at its front end for impact forging to thereby form the second semifinished product 826 of the neck base 441 and the neck body 442 shown in FIG. 3; wherein, the depth of the female die 82 die cavity 821 is less shallow than that of the first step female die 81 die cavity 811.

Figure 8:
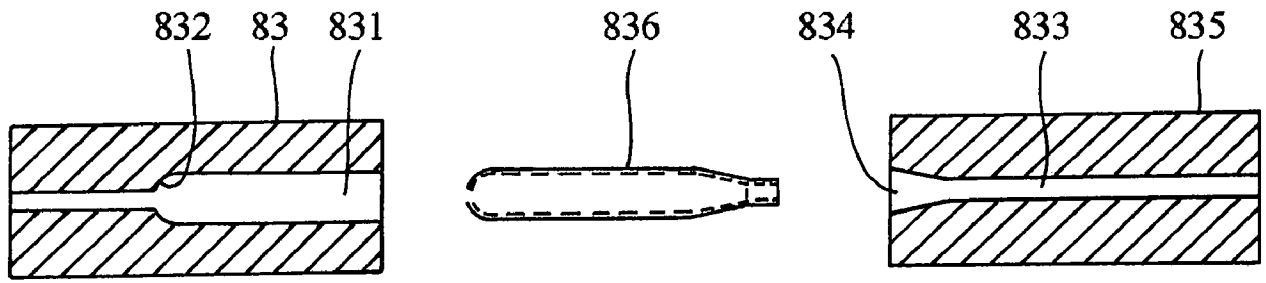
FIG. 8 is a cross-sectional drawing of the fourth step in the preferred embodiment fabrication of the invention herein.

A fourth step, referring to FIG. 8, in which the tubular member 8, formed into the second semifinished product 826 of the previous step, is moved between a female die 83 having a die cavity 831 and a curved bottom edge 832 and a punching die 835 having a channel 833 and a suitably long flared hole section 834 at its front end for impact forging to thereby form the third semifinished product 836 of the neck base 441 and the neck body 442 shown in FIG. 3; wherein, the punching die 835 flared hole 834 is closer to the finished product dimensions than that of the previous step.

Figure 9:
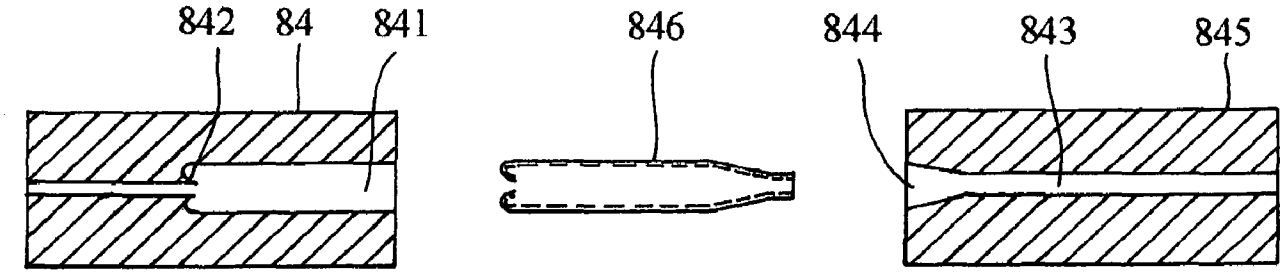
FIG. 9 is a cross-sectional drawing of the fifth step in the preferred embodiment fabrication of the invention herein.

A fifth step, referring to FIG. 9, in which the tubular member 8, formed into the third semifinished product 836 of the previous step, is moved between a female die 84 having a die cavity 841 and a circular groove-shaped bottom edge 842 and a punching die 845 having a channel 843 and a suitably long flared hole section 844 at its front end for impact forging to thereby form the fourth semifinished product 846 of the tube member 5 having a hole mount 51 surrounding the bottom section aperture 511 as shown in FIG. 3.

Figure 10:
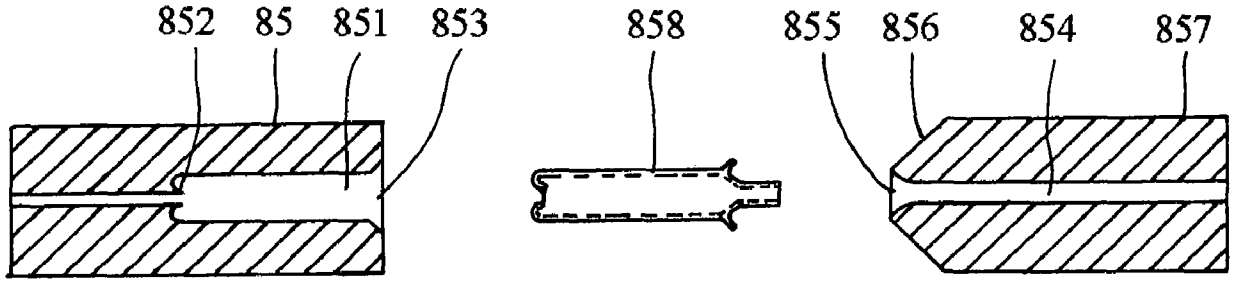
FIG. 10 is a cross-sectional drawing of the sixth step in the preferred embodiment fabrication of the invention herein.

A sixth step, referring to FIG. 10, in which the tubular member 8, formed into the fourth semifinished product 846 of the previous step, is moved between a female die 85 having a die cavity 851, a circular groove-shaped bottom edge 852, and a flared opening 853 and a punching die 857 having a channel 854, a suitably long flared hole section 855 at its front end, and a conical edge 856 for impact forging to form the finished product 858 having the outer conoidal hem 41 and the inner conoidal hem 42 shown in FIG. 3.

In the preferred embodiment of the invention herein, the fourth and the fifth steps can be combined, wherein the fourth step female die 83 and the fifth step female die 84 are alternated such that during the fourth step, in addition to forging the neck base 441 and the neck body 442 into predetermined product dimensions, the tube member 5 bottom section aperture 511 is formed and completed at the same time.

The completed temperature sensing tube of the invention here can be fabricated without the hole mount 51 and, as a result, if the hole mount 51 is not needed, this is achieved by only executing first, the second, the fourth, and the sixth steps; if the hole mount 51 is required, this is achieved by executing the first, the second, the third, the fourth, the fifth, and the sixth steps and, additionally, the said combination of the fourth and the fifth steps during fabrication.

While the present invention has been described in relation to what is considered the most practical and preferred embodiments, it is understood that the invention herein is not limited to the disclosed embodiments, but is intended to cover various arrangements included within the spirit and scope of the broadest interpretations and equivalent arrangements.

The invention claimed is:

1. A temperature sensing tube fabrication method comprising the steps of:

providing a tubular member of an appropriate length;

forming a curvilinear bottom end of the tubular member to define a bottom section aperture;

forming a neck base and a neck body at a top end of the tubular member; and forming an outer conoidal hem and an inner conoidal hem on the tubular member proximate to said neck base;

wherein the curvilinear bottom end defining the bottom section aperture is formed having a bottom section hole mount in a step between the step of forming the neck base and the neck body and the step of forming the outer conoidal hem and the inner conoidal hem.

2. The method according to claim 1, wherein during the step of forming the neck base and the neck body, the bottom section aperture is formed at the same time.

3. A temperature sensing tube fabrication method comprising the steps of:

providing a tubular member of an appropriate length;

moving the tubular member between a first female die having a die cavity and a curved bottom edge and a punching rod having a thin lengthy rod section and a curved front end section for impact forging to thereby form a curvilinear bottom end of the tubular member to define a bottom section aperture;

moving the tubular member between a second female die having a die cavity and a curved bottom edge and a punching die having a channel and a suitably long flared hole section at its front end for impact forging to thereby form a neck base and a neck body at a top end of the tubular member;

moving the tubular member between a third female die having a die cavity and a curved bottom edge and a punching die having a channel and a suitably long flared hole section at its front end for impact forging to thereby further form the neck base and the neck body; and moving the tubular member between a fourth female die having a die cavity, a circular groove-shaped bottom edge, and a flared opening and a punching die having a channel, a suitably long flared hole section at its front end, and a conical edge for impact forging to form an outer conoidal hem and an inner conoidal hem.

4. The method according to claim 3, wherein during the step of forming the neck base and the neck body, the third female die includes a circular groove-shaped bottom edge to form a bottom section hole mount at the same time.

5. The method according to claim 3, further comprising between the step of forming the neck base and the neck body and the step of forming the outer conoidal hem and the inner conoidal hem, a step of moving the tubular member between a female die having a cavity and a circular groove-shaped bottom edge and a punching die having a channel and a suitably long flared hole section at its front end for impact forging to form a bottom section hole mount.

* * * * *